US007380748B2

(12) United States Patent
Goeking et al.

(10) Patent No.: US 7,380,748 B2
(45) Date of Patent: Jun. 3, 2008

(54) TOWEL DISPENSER WITH IMPROVED DRIVE ROLL AND IMPROVED DISPENSING CHUTE

(75) Inventors: Harold J. Goeking, Oshkosh, WI (US); Paul Metcalfe, Solon, OH (US); Michael R. Kilgore, Little Suamico, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 183 days.

(21) Appl. No.: 11/296,088

(22) Filed: Dec. 7, 2005

(65) Prior Publication Data

US 2006/0138274 A1 Jun. 29, 2006

Related U.S. Application Data

(60) Provisional application No. 60/635,788, filed on Dec. 14, 2004.

(51) Int. Cl.
*B65H 16/10* (2006.01)

(52) U.S. Cl. ..... 242/564.2; 242/564.4; 242/615.2

(58) Field of Classification Search ..... 242/564, 242/564.1, 564.2, 564.3, 564.4, 596.8, 615.2, 242/580; 226/127–129; 312/34.22, 34.8
See application file for complete search history.

(56) References Cited

U.S. PATENT DOCUMENTS

| | | | | |
|---|---|---|---|---|
| 3,038,598 A | | 6/1962 | Layton et al. | 206/58 |
| 3,606,125 A | | 9/1971 | Tucker et al. | 226/130 |
| 4,236,679 A | * | 12/1980 | Jespersen | |
| 4,260,117 A | | 4/1981 | Perrin et al. | 242/564.2 |
| 4,358,169 A | | 11/1982 | Filipowicz et al. | 312/39 |
| 4,378,912 A | | 4/1983 | Perrin et al. | 242/560.1 |
| 4,403,748 A | | 9/1983 | Cornell | 242/560.1 |
| 4,635,771 A | | 1/1987 | Shoji et al. | 192/41 A |
| 4,756,485 A | | 7/1988 | Bastian et al. | |
| 4,807,824 A | | 2/1989 | Gains et al. | 242/560.1 |
| 4,846,412 A | | 7/1989 | Morand | |
| 5,655,722 A | | 8/1997 | Muckridge et al. | |
| 5,924,617 A | | 7/1999 | LaCount et al. | 225/16 |
| D417,109 S | | 11/1999 | Johnson et al. | D6/518 |
| 5,979,822 A | | 11/1999 | Morand et al. | 242/564.2 |
| 6,032,898 A | | 3/2000 | LaCount et al. | 242/564.2 |
| 6,105,898 A | | 8/2000 | Byrd et al. | 242/564.1 |
| 6,237,871 B1 | | 5/2001 | Morand et al. | 242/564.2 |

(Continued)

FOREIGN PATENT DOCUMENTS

| | | | |
|---|---|---|---|
| CA | 918610 | 1/1973 | 219/12 |

(Continued)

*Primary Examiner*—William A Rivera
(74) *Attorney, Agent, or Firm*—Joel T. Charlton

(57) ABSTRACT

In a dispenser for dispensing rolls of paper towel including means for rotatably mounting the roll, a feed nip including a segmented drive roll with a plurality of drive surfaces and a nip roll adapted to cooperate therewith to advance the towel to a dispensing chute, an improved drive roll having an elongate axis and a plurality of drive segments defining drive surfaces disposed along its length of generally equal radius with respect to the elongate axis of the roll, as well as a plurality of guide disks interposed between adjacent drive segments configured to alleviate wrinkling as the towel is dispensed. Further improvements include a textured delivery chute and a method for dispensing a partially depleted roll of towel together with a fresh roll.

20 Claims, 9 Drawing Sheets

U.S. PATENT DOCUMENTS

| | | | | |
|---|---|---|---|---|
| 6,250,530 | B1 | 6/2001 | LaCount et al. | 225/10 |
| 6,336,542 | B1 | 1/2002 | Mintonye, II | 193/37 |
| 6,581,500 | B1 * | 6/2003 | Kietaibl | |
| 6,592,067 | B2 * | 7/2003 | Denen et al. | |
| 6,826,991 | B1 | 12/2004 | Rasmussen | 87/334 |
| 2003/0164079 | A1 * | 9/2003 | Budz et al. | |

FOREIGN PATENT DOCUMENTS

| | | | |
|---|---|---|---|
| CA | 918611 | 1/1973 | 219/12 |
| EP | 0 319 166 | 6/1989 | |

* cited by examiner

TOWEL DISPENSER WITH IMPROVED DRIVE ROLL AND IMPROVED DISPENSING CHUTE

CLAIM FOR PRIORITY

This non-provisional application is based upon U.S. Provisional Patent Application Ser. No. 60/635,788 filed on Dec. 14, 2004, of the same title. The priority of U.S. Provisional Patent Application Ser. No. 60/635,788 is hereby claimed and the disclosure thereof is incorporated into this application by reference.

TECHNICAL FIELD

The present invention relates to dispensers for paper towel rolls and in particular to an improved drive roll to be used in a feed nip typical to such dispensers and an improved dispensing chute tray which has a textured surface to reduce friction between the towel and dispensing chute tray surface.

BACKGROUND

Paper towel dispensers of the class used for commercial establishments frequently include a drive mechanism for feeding a roll of towel over a cutting blade. A lever or the like is used to advance the towel, while the blade severs a length of towel from a roll when the portion of the towel protruding from a dispensing chute is grasped and removed. The chute/blade geometry is preferably configured to facilitate cutting. To this end, the blade is oftentimes a serrated blade and the feed nip, cutting blade and dispensing apertures of the chute are suitably positioned. Such dispensers are well known. One design which may be employed in connection with the present invention is shown in U.S. Pat. No. DES 417,109 to Johnson et al. The design of the '109 patent includes a generally cylindrically shaped upper portion and a lower, forward facing delivery area for dispensing towel.

It is well known in the art to provide towel dispensers with a dispensing mechanism including a drive roll coupled to a reciprocating operating lever. In this respect there is shown in U.S. Pat. No. 3,606,125 to Tucker et al. a towel dispenser provided with a reciprocating lever. The lever is coupled to a pair of gear racks internal to the dispenser. These gear racks each engage a respective drive gear, one of which is idle during operation, depending on the stroke direction. This action is achieved through a plurality of engagement mechanisms as can be seen in the '125 patent. See also Canadian Patent No. 918,610 and 918,611 also to Tucker et al.

Towel dispensers of the type used in a commercial establishments frequently include those adapted to dispense towels from a primary roll and a reserve roll. These dispensers typically include a rotatable dispensing drive roller and a means for feeding the sheet material from the reserve roll when the primary roll is depleted. In this respect, there is shown in U.S. Pat. No. 4,378,912 to Perrin et al. a dispenser including a rotatable dispensing roller with a groove, sensing means for entering the groove when sheet material from the primary roll is depleted and tucker means responsive to movement of the sensing means to engage the reserve roll of sheet material and introduce it into a nip between rotatable rollers. That is to say, when the primary roll becomes depleted the tucker means will urge material from the reserve roll into the nip between the nip and drive roll to start dispensing from the reserve roll of paper towel. Such towel dispensers may or may not include a push-bar. See, U.S. Pat. No. 5,979,822 to Morand et al.

Despite many advances in the art, drawbacks of existing dispensers include wrinkling and binding of towel during of the dispensing process as well as expense in terms of materials and labor for assembling intricate feed or switching systems. Moreover, existing dispensers tend to have levers and open areas which can lead to microbial contamination of hands after washing or can lead to microbial contamination of towel before it is dispensed. The present invention provides an improved push-bar, low weight drive mechanism which reduces wrinkling. Housing and parts are injection molded to reduce parts and promote a more hygienic enclosure. In further aspects of the invention, the dispensing chute is textured to reduce friction and binding of towel to the chute surface as towel is dispensed. The various improvements of the invention are readily employed in connection with dispensers of the class generally described above.

SUMMARY OF INVENTION

The present invention relates to towel dispensers of the class shown in U.S. patent application Ser. No. 10/366,120; United States Publication No. 2003/0164079 A1. In one aspect of the invention, there is provided an improved segmented drive roll having an elongate axis and a plurality of drive segments defining drive surfaces disposed along its length of generally equal radius with respect to the elongate axis of the roll, as well as a plurality of guide disks interposed between adjacent drive segments configured to alleviate misfeeding and wrinkling as the towel is dispensed. Generally, the guide disks have an axial span which is less than about 50% if an axial span of any drive segment; typically, the guide disks have an axial span which is less than about 30% if an axial span of any drive segment. So also, the guide disks are preferably of a radius from the elongate axis of the drive roll substantially the same as the radius of the drive surfaces with respect to the elongate axis of the drive roll. While any suitable number of guide disks may be disposed along the shaft, suitably, there are from 2 to 5 guide disks interposed between adjacent drive segments with 3 guide disks interposed between adjacent drive segments shown in the drawings.

In a preferred construction, the drive segments have a substantially cylindrical rigid mounting disk with a support surface and disposed thereabout a band of elastomer material, which elastomer band operates as the drive surface of the drive segment. This drive roll is an injection molded drive roll, wherein the mounting disks with the support surfaces and the guide disks are parts of a unitary injection molded structure; and the guide disks are of a radius which exceeds the radius of the mounting disks by about the thickness of the elastomer band. The injection molded drive roll is injected molded from any suitable injection molding composition; including a molding composition with a polymeric resin selected from the group consisting of ABS resins, polycarbonate resins, polyester resins, polyacetal resins and nylon resins.

In another aspect of the invention there is provided a dispenser for dispensing rolls of paper towel comprising: (a) a housing; (b) means for rotatably mounting rolls of paper towel in the housing; (c) a feed nip including a drive roll and a nip roll adapted to cooperate to advance the towel to a dispensing chute; (d) a cutter bar disposed between the feed nip and the dispensing chute; wherein the dispensing chute is provided with a textured delivery tray surface configured to guide the dispensed towel forward toward a dispensing aperture. The textured delivery tray surface of the dispensing tray is preferably an injection-molded tray surface produced in a textured mold. Suitably, the textured mold has a surface finish at least as rough as an SPI D-2 surface finish; a textured mold with a surface finish at least as rough as an SPI D-3 surface finish is believed more preferred.

The textured surface eliminates the need for unsightly ribs to reduce towel/surface friction on the delivery tray and uses less material making for a more economical and efficient construction of the device; the improvement thus comprising providing the delivery chute with a textured delivery tray surface configured to guide dispensed towel forward over the cutter bar to a dispensing aperture, wherein the textured delivery tray surface has a topography free from projections other than the texture provided thereto. Preferably, the surface of the delivery tray has a texture of less than about 100 microns. "Texture" in quantitative terms referring to the maximum distance that surface features project from their base over the surface of the dispensing tray.

In another aspect of the invention there is provided a method of dispensing paper towel from a primary feed roll and a partially depleted stub roll comprising: (a) providing a towel dispenser with housing, an elevated mounting rack for rotatably mounting a primary feed towel roll, a stub roll cavity below the elevated towel mounting rack and drive means for advancing paper towel from the rolls to a dispensing chute, the drive means consisting of: a feed nip with (i) a drive roll and (ii) a nip roll as well as (iii) means for rotating the drive and nip rolls; (b) rotatably mounting a primary feed paper towel roll on the elevated mounting rack; (c) concurrently with step (b), disposing a partially depleted stub roll in the stub roll cavity below the primary feed roll; (d) concurrently with steps (b) and (c), providing towel from both the primary feed roll and the stub roll into the feed nip such that towel from both the primary feed roll and the stub roll are advanced when the drive and nip rolls are rotated in a dispensing direction; and (e) simultaneously dispensing towel from both the primary feed roll and the stub roll through the feed nip.

The inventive method eliminates the need for complex internal assemblies for switching from one roll to another.

Further features and advantages will become apparent from the discussion which follows.

BRIEF DESCRIPTION OF DRAWINGS

The invention is described in detail below in connection with the various Figures wherein like numerals indicate like parts and wherein.

DETAILED DESCRIPTION

Figure 1:
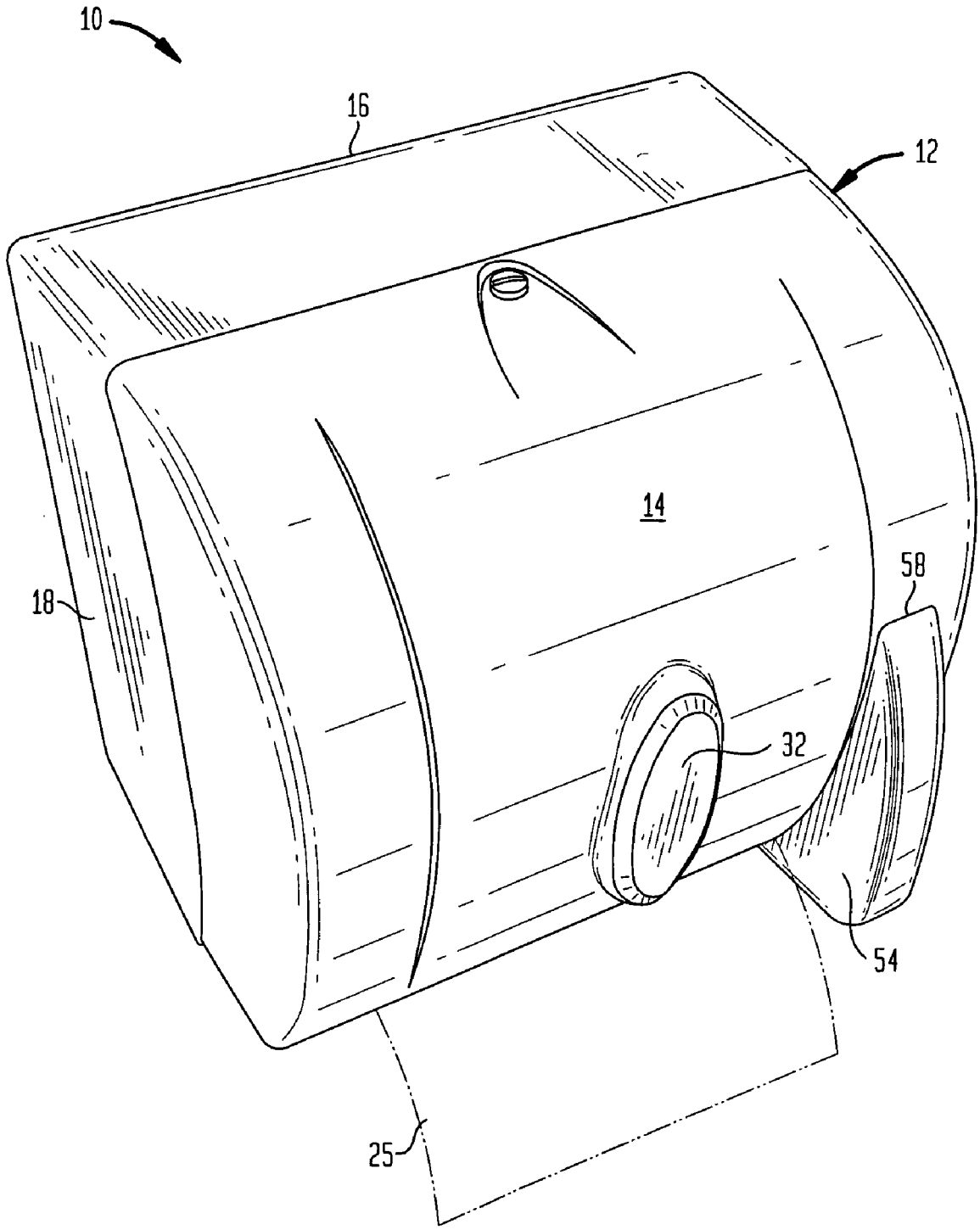
FIG. 1 is a perspective view of a paper towel dispenser of the present invention.

The invention is described in detail below in connection with the various figures. Such description and illustration is for purposes of exemplification only; modifications within the spirit and scope of the present invention, set forth in the appended claims, will be readily apparent to those of skill in the art.

Referring to FIGS. 1 through 7 there is shown a paper towel dispenser 10 which includes a housing 12. Housing 12 has a front cover 14 hinged to a rear housing portion 16 which has side panels 18 and 20 as well as a rear panel 22. Mounted on rear panel 22 there is provided a rack 24 for mounting a roll of paper towel 25. Rack 24 includes a first bracket 26 as well as a second bracket 28. The brackets have mounting bosses for holding the towel roll such as boss 30.

In order to evaluate towel inventory, there is provided a sight glass 32 on the front of cover 14 so that a technician can observe the amount of towel remaining on a feed roll 25.

Paper towel is fed to a feed nip 36 which includes a drive roll 38 as well as a nip roll 40 which feeds towel 25 over a cutter bar 34. Drive roll 38 is mounted on a drive shaft 42 which has a pinion 44 preferably mounted on a one way bearing at 46. A push bar assembly 48 has a drive member 50 with an integrally formed rack 52 for driving pinion 44 and operating the dispenser. The push bar assembly 48 also has push bar plate 54 which preferably has a baffle 56 which helps maintain slot 58 in a closed or shielded position even when the push bar is retracted into slot 58 when pushed to dispense towel. In other words, baffle 56 is configured to substantially seal slot 58 even when the push bar is pushed inwardly to drive roll 38 and dispense more towel.

There is further provided a dispensing chute module 60 having a tray 62 provided with a textured tray surface 64. As noted above surface 64 is preferably provided with a textured surface having a surface roughness corresponding to that of an SPI D-3 finish.

Preferably, all parts are injection molded for efficient fabrication and in order to make the enclosure hygienic; that is, to substantially isolate the interior of the dispenser from its surroundings. Also, push bar assembly 48 may be pushed inwardly without using fingers or hands, if so desired. A user may use a forearm or other means to activate the dispenser. Injection molding allows for modular construction as is appreciated perhaps best by reference to FIGS. 4B-4C. Chute module 60 includes tray 62 as well as an upper plate, while push bar module 68 includes push bar assembly 48 with drive member 50 and activator push bar plate 54 as well as a wall for mounting the assembly. The modules are conveniently assembled with assembly posts while guide posts facilitate operation of the dispenser.

The improved drive roll 38 of the present invention is perhaps better understood by reference to FIGS. 5A through 6B.

Figure 5A:
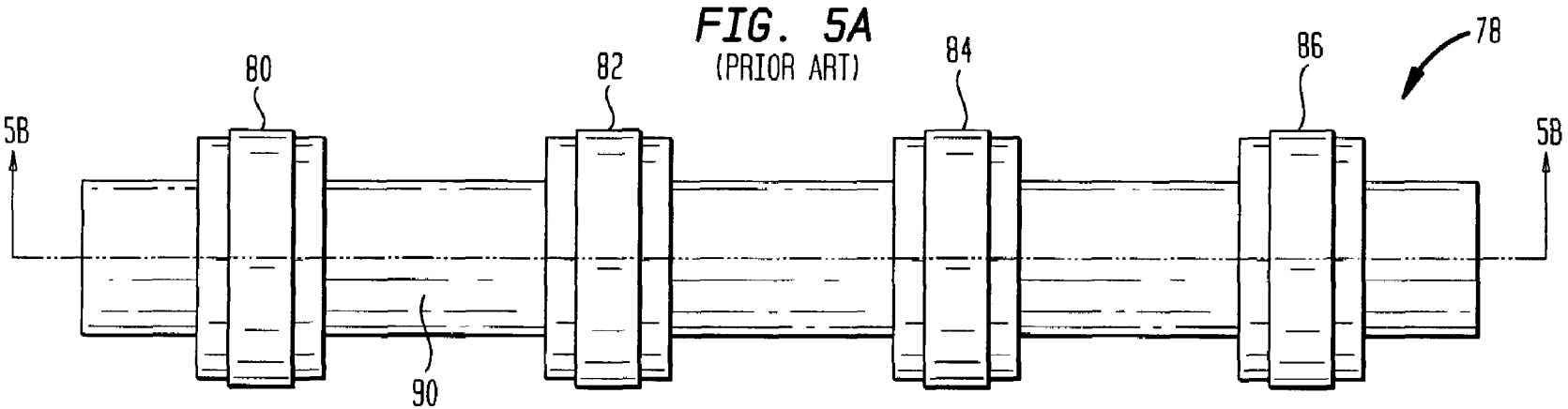
FIG. 5A (PRIOR ART)
FIG. 5A is a side view of a prior art drive roller used in towel dispensers.
Figure 5B:
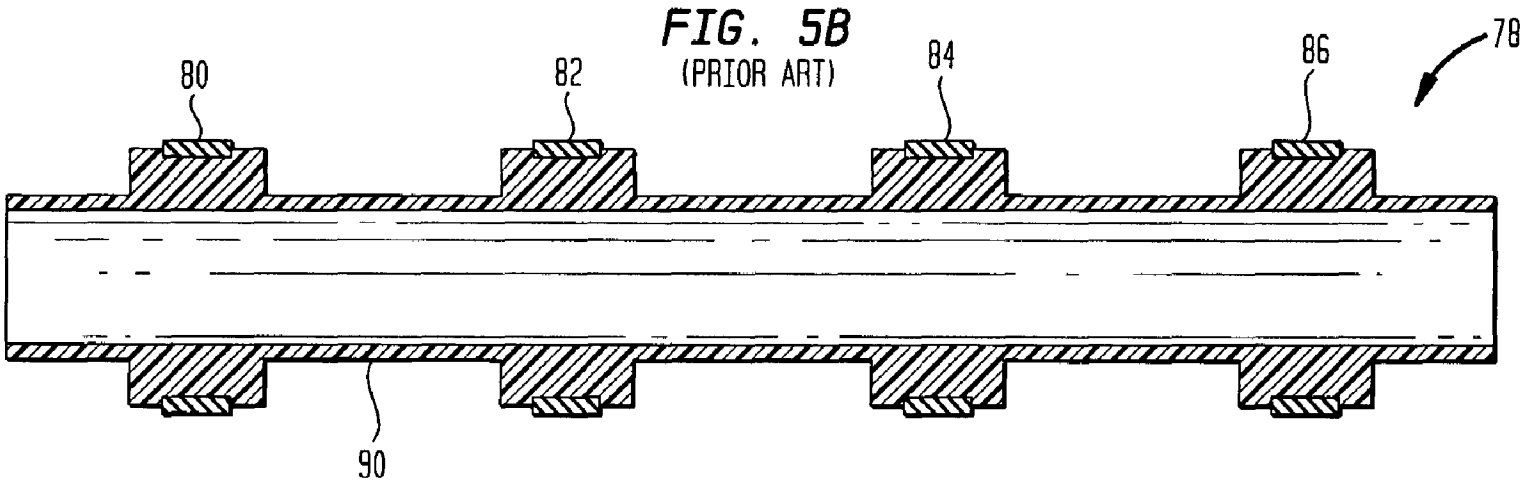
FIG. 5B (PRIOR ART)
FIG. 5B is a view in section of the drive roll of FIG. 5A.

FIG. 5A and FIG. 5B are illustrations of prior art drive rollers used in towel dispensers.

Prior art drive roll 78 is a segmented drive roll having a plurality of spaced drive surfaces 80, 82, 84 and 86. The drive surfaces are spaced apart on a shaft 90. It will be appreciated from the various diagrams that there is a gap between the drive surfaces and central shaft 90 which leads to towel wrinkling or misfeeding of the product.

Figure 2:
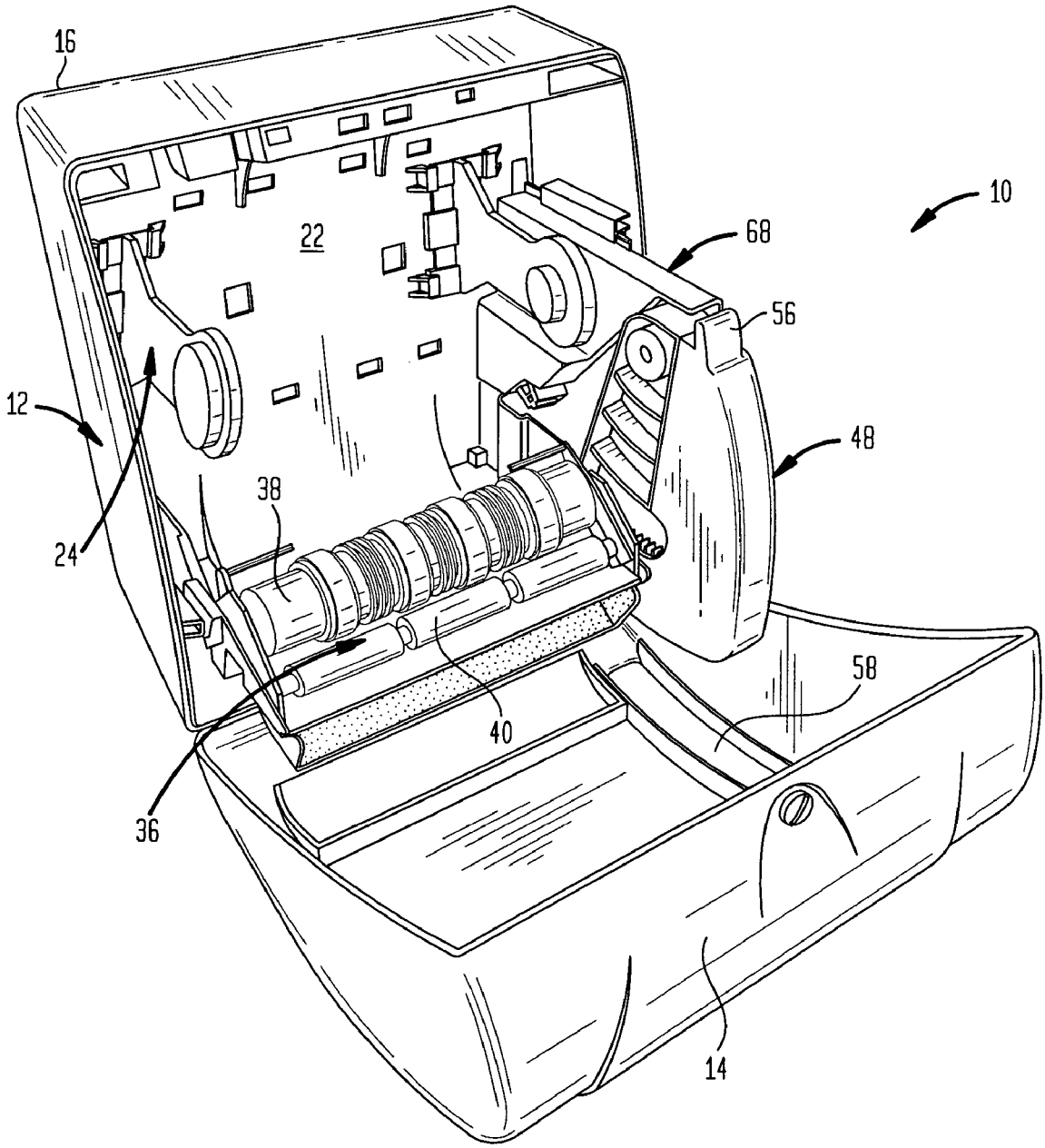
FIG. 2 is a perspective view of a towel dispenser of FIG. 1 with the cover open.
Figure 3:
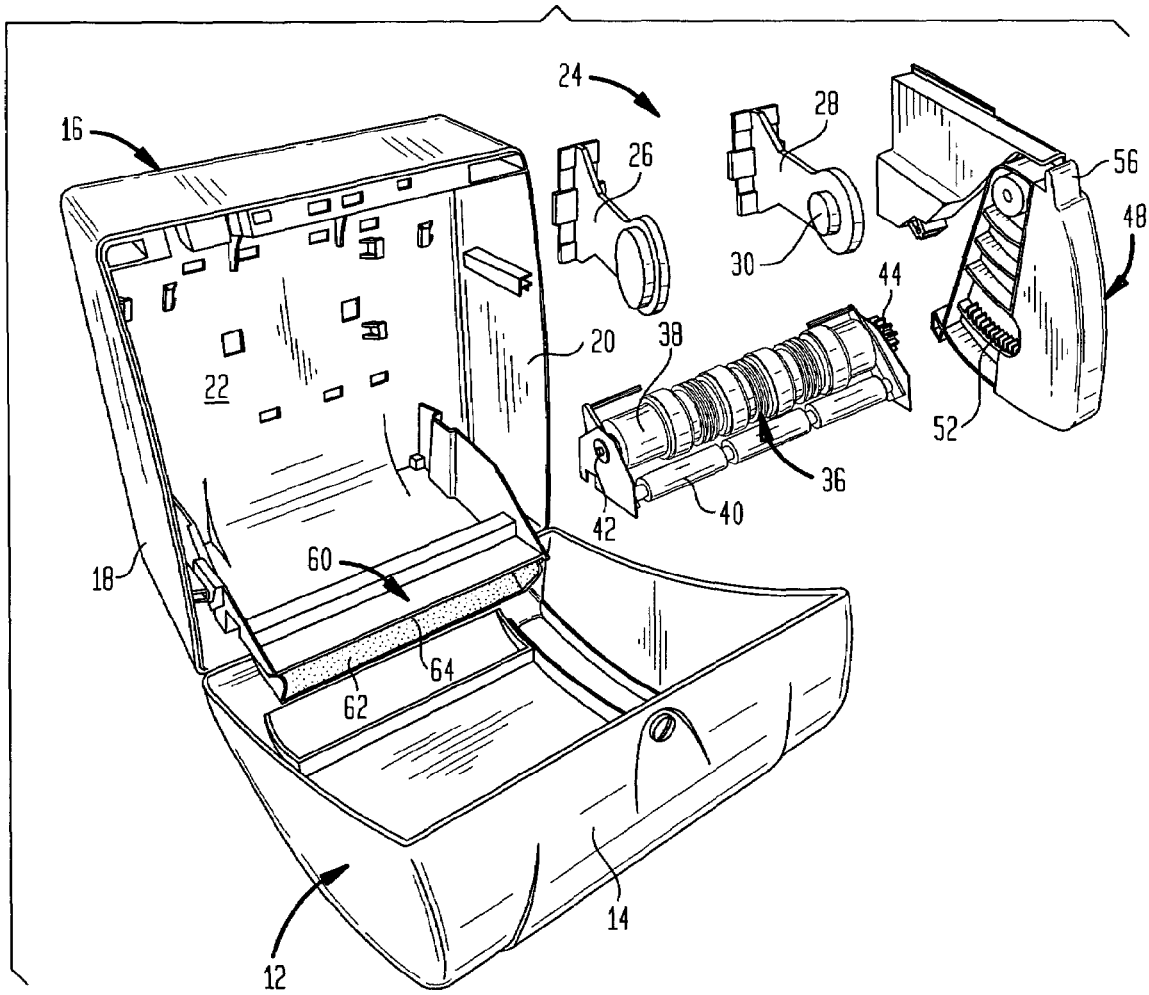
FIG. 3 is an exploded view of the towel dispenser of FIGS. 1 and 2 showing various modular sub-assemblies.
Figure 4A:
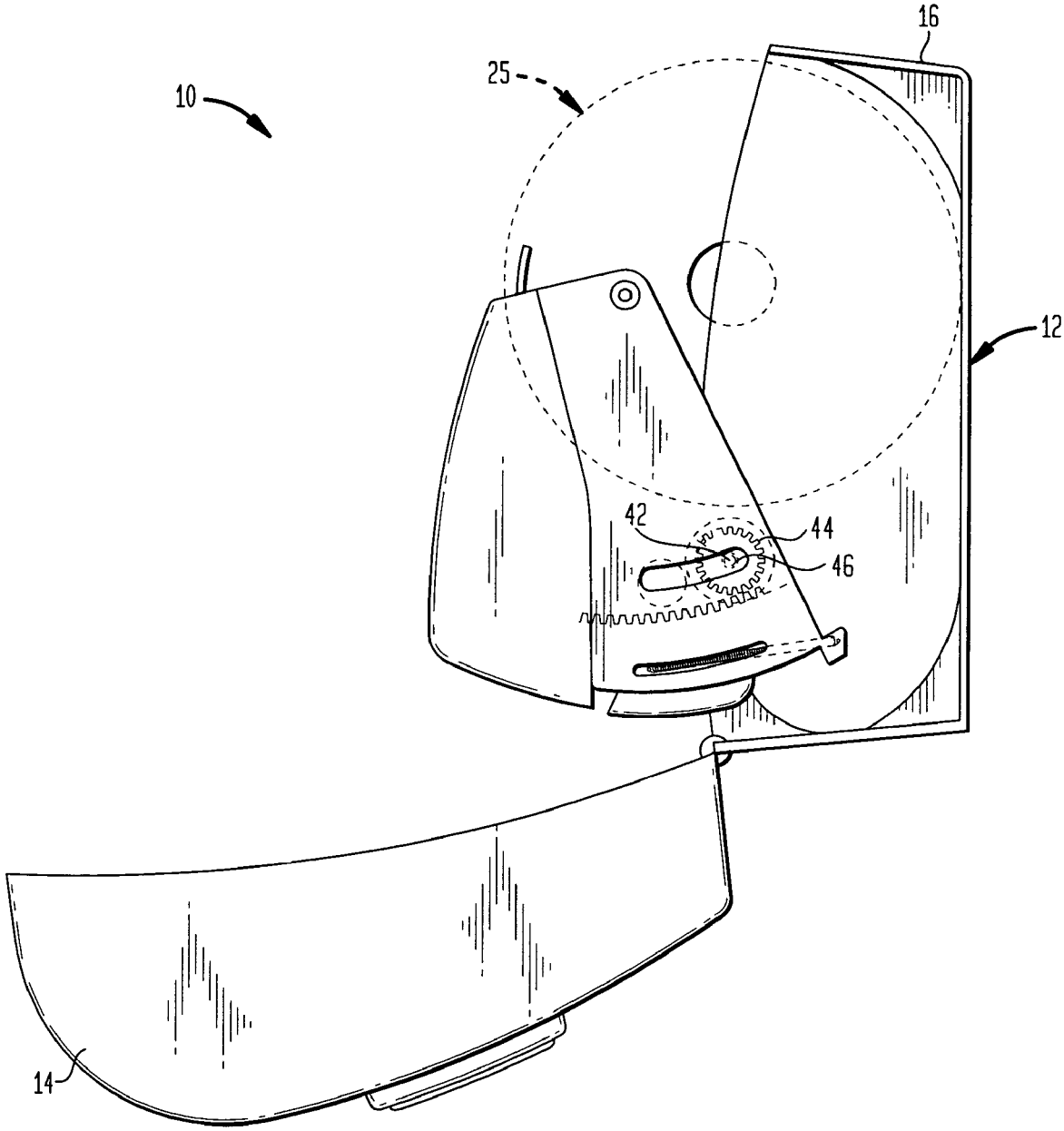
FIG. 4A is a view in elevation illustrating various parts.
Figure 4B:
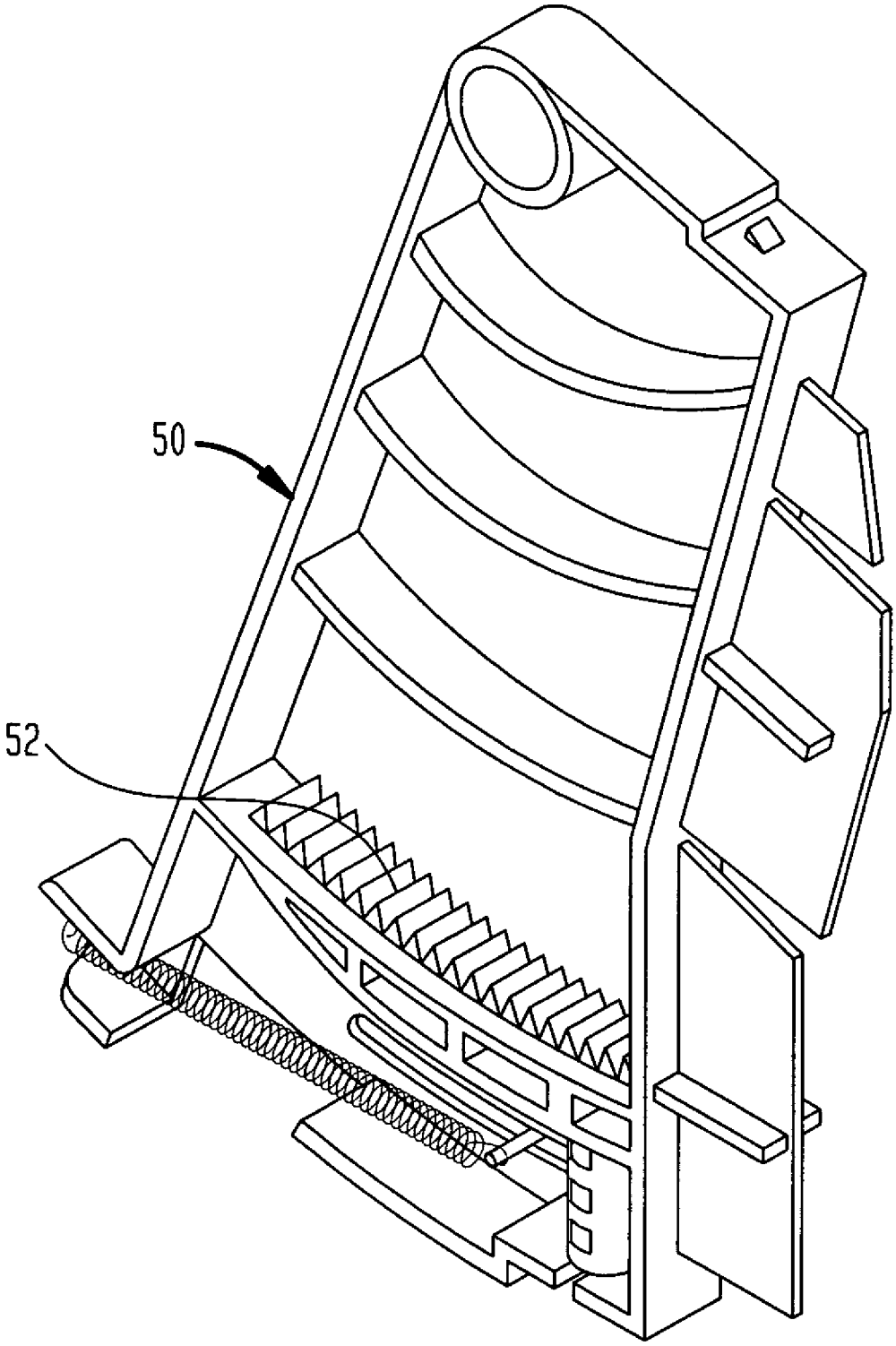
FIG. 4B is a view in perspective of a push bar with a molded in gear rack which is used in the dispenser of FIG. 1.
Figure 4C:
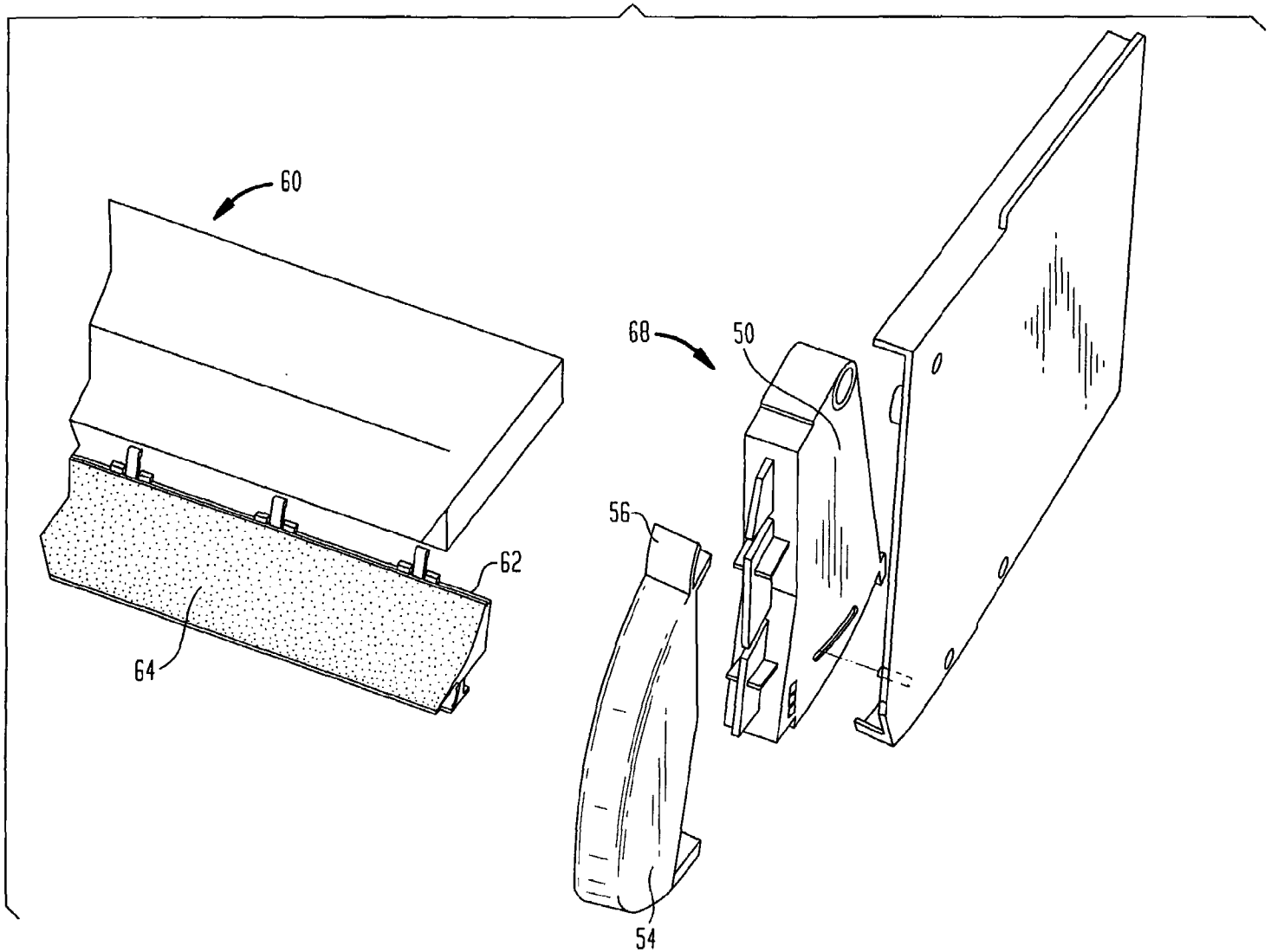
FIG. 4C is an exploded view in perspective showing various parts of the dispenser.
Figure 6A:
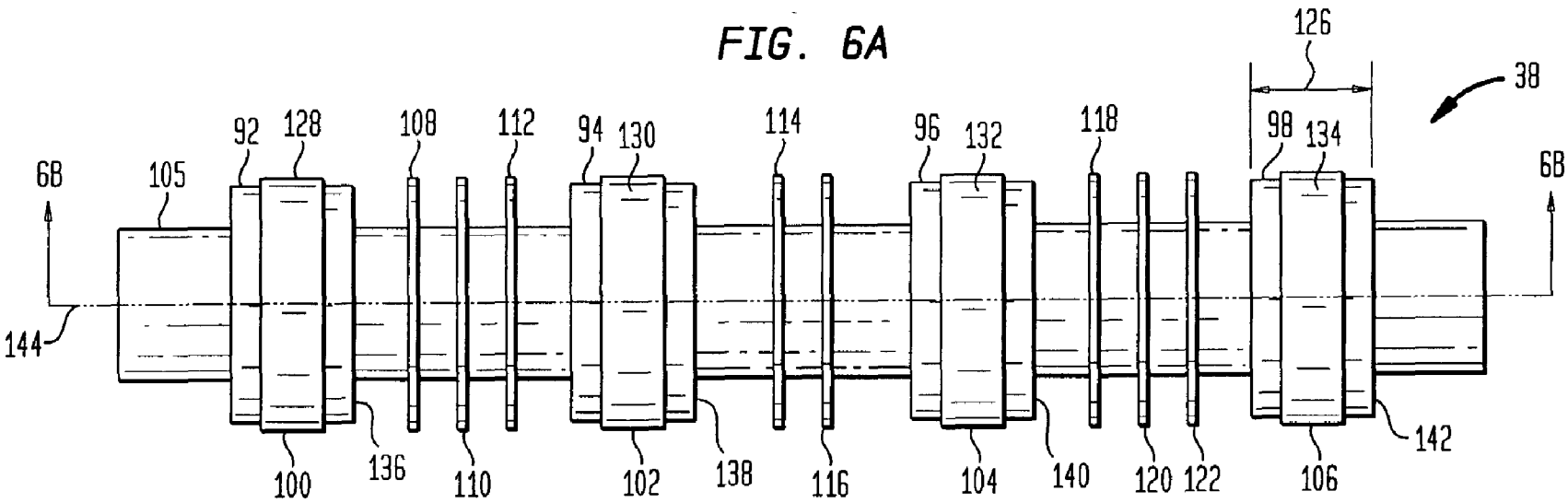
FIG. 6A is a side view of a drive roller of the present invention.
Figure 6B:
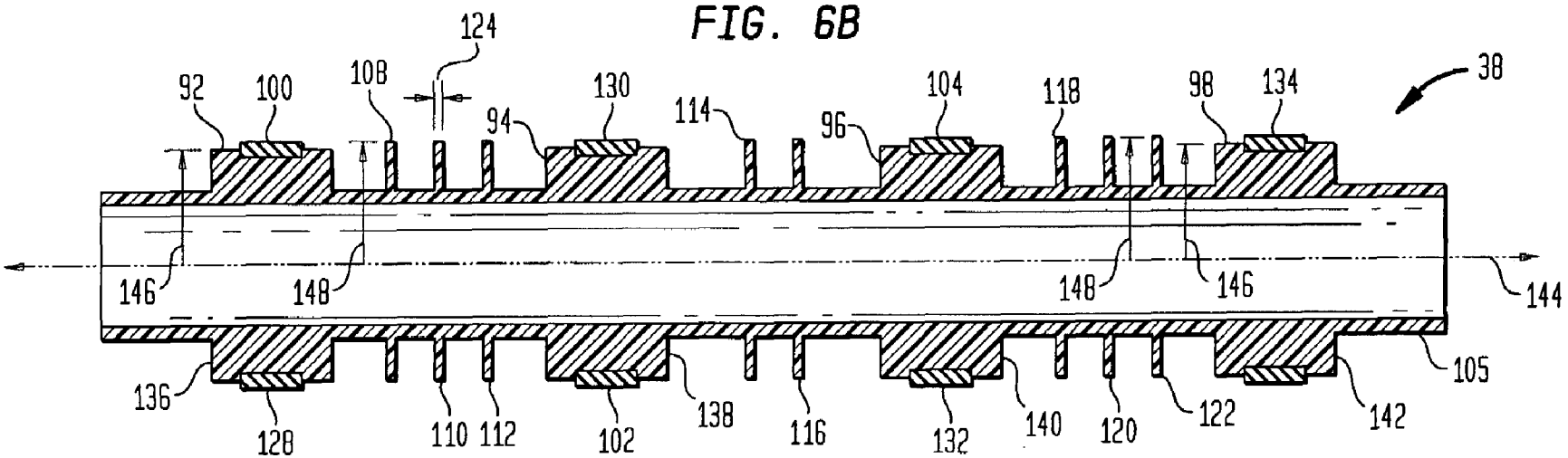
FIG. 6B is a view in section of a drive roller of the present invention.

A drive roller of the invention is shown in FIGS. 2, 3 and especially in FIGS. 6A and 6B. The inventive drive roller 38 has a plurality of drive segments 92, 94, 96 and 98 having drive surfaces 100, 102, 104 and 106, outwardly disposed with respect to a shaft 105. As can be seen, the drive roll is a segmented drive roll; here, however, there are provided a plurality of guide discs 108, 110, 112, 114, 116, 118, 120, 122, and so forth interposed between the drive surfaces.

Each guide disc has an axial span 124 which is much less than the axial span 126 of the drive segments.

It is further noted that the drive segments include an elastomer band such as bands 128, 130, 132 and 134 mounted on a substantially cylindrical rigid mounting disc such as discs 136, 138, 140 and 142. The mounting discs are much broader, that is, have much more axial span than the elastomer bands 128 through 134. The elastomer bands define the drive surfaces in a preferred embodiment shown in the various Figures.

Preferably, drive roll 38 is fabricated by injection molding and is dimensioned such that the drive surfaces 100 through 106 are of generally equal radius with respect to an elongate axis 144 of the drive roll. In a particularly preferred embodiment, the guide discs are of a radius such as radius 146 which exceeds the radius such as radius 148 of the mounting discs by about the thickness of the elastomer bands 128 through 134 such that the guide surfaces of the discs and the drive surfaces of the drive segments are of substantially equal radius with respect to elongate axis 144 of the drive roll.

A further salient feature of the present invention is a textured chute as noted above. Particularly important is textured tray surface 64 which prevents or alleviates frictional binding of towel from roll 25 to the delay surface. This feature promotes smooth delivery of product.

A still further aspect of the invention is a novel method of simultaneously feeding product from a fresh feed roll such as roll 25 and a stub roll such as roll 125.

Figure 7:
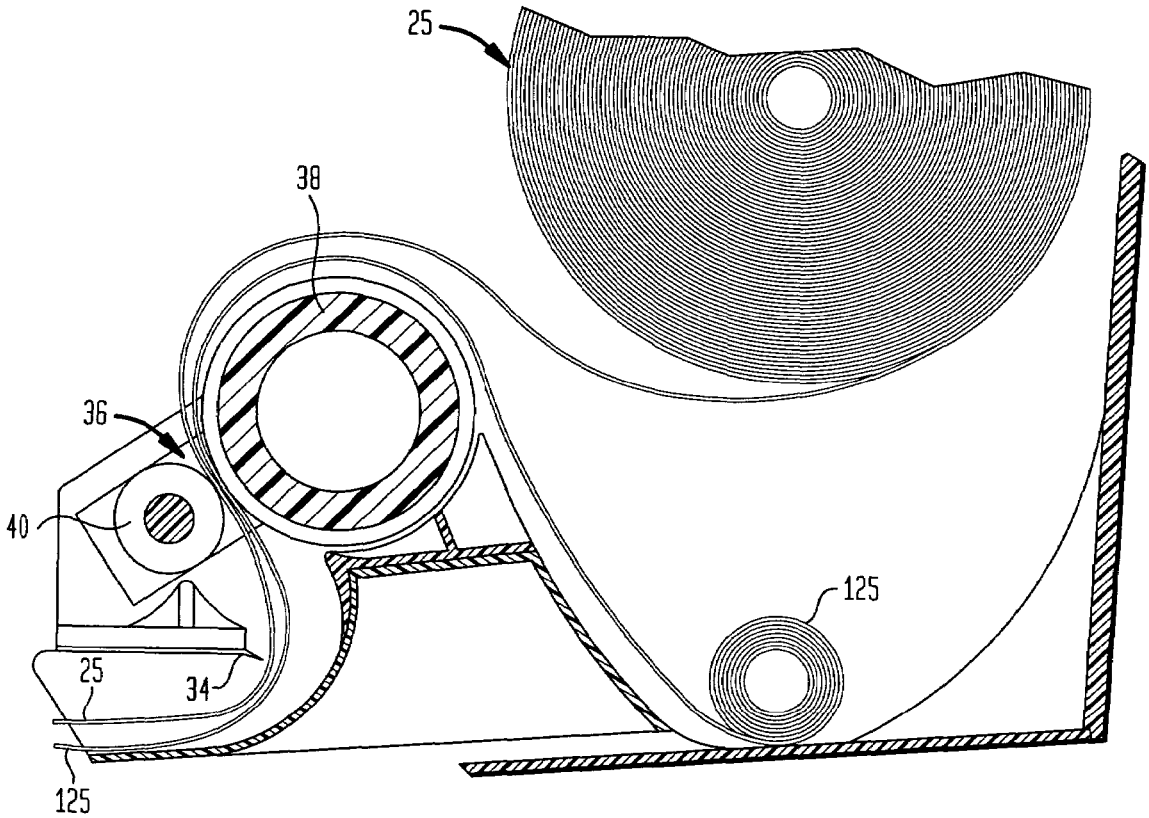
FIG. 7 is a schematic view in elevation illustrating the dispenser geometry as well as a method of dispensing towel from a fresh feed roll and a stub roll in accordance with the present invention. Note that the views of FIGS. 5A through 6B are enlarged with respect to other views in order to show details of the drive rollers.

To this end, roll 25 is mounted on towel rack 24 of dispenser 10. At the same time, a partially depleted or stub roll is disposed in a stub roll cavity 130 of the dispenser. Towel 25 is fed into feed nip 36 together with towel 125 such that towel from both rolls is fed through the nip as shown in FIG. 7. In other words, the inventive method includes mounting a roll 25 in the towel rack while at the same time disposing a partially depleted stub roll in the stub roll cavity. The towel from the primary feed roll and the stub roll is fed into the nip such that towel from both the primary feed roll and the stub roll are advanced when the drive and nip rolls are rotated in a dispensing direction for example by pushing push bar assembly 48 into the dispenser so that rack 52 drives pinion 44. Pinion 44, in turn, drives shaft 42 and drive roll 38. The towel is in contact with the feed nip and thus fed when the nip is rotated.

The towel dispenser has drive means consisting of feed nip 36 which has a drive roll and a nip roll as well as means for rotating the drive and nip rolls. This configuration eliminates the need for complex apparatus and mechanisms for switching feed from one roll to another. Also, the towel from stub roll 125 is not discarded but fed with towel 25 to a consumer.

While the invention has been described in connection with several examples, modifications to these examples within the spirit and scope of the invention will be readily apparent to those of skill in the art. In view of the foregoing discussion, relevant knowledge in the art and references discussed above in connection with the Background, Summary of Invention and Detailed Description, the disclosures of which are all incorporated herein by reference, further description is deemed unnecessary.

The invention claimed is:

1. In a dispenser for dispensing rolls of paper towel including means for rotatably mounting the roll, a feed nip including a segmented drive roll with a plurality of drive surfaces and a nip roll adapted to cooperate therewith to advance the towel to a dispensing chute, an improved drive roll having an elongate axis and a plurality of drive segments defining drive surfaces disposed along its length of generally equal radius with respect to the elongate axis of the roll, as well as a plurality of guide disks interposed between adjacent drive segments configured to alleviate wrinkling as the towel is dispensed.

2. The improved drive roll according to claim 1, wherein the guide disks have an axial span which is less than about 50% if an axial span of any drive segment.

3. The improved drive roll according to claim 1, wherein the guide disks have an axial span which is less than about 30% if an axial span of any drive segment.

4. The improved drive roll according to claim 1, wherein the guide disks are of a radius from the elongate axis of the drive roll substantially the same as the radius of the drive surfaces with respect to the elongate axis of the drive roll.

5. The improved drive roll according to claim 1, wherein there are from 2 to 5 guide disks interposed between adjacent drive segments.

6. The improved drive roll according to claim 1, wherein there are 3 guide disks interposed between adjacent drive segments.

7. The improved drive roll according to claim 1, wherein the drive segments have a substantially cylindrical rigid mounting disk with a support surface and disposed thereabout a bad of elastomer, which elastomer band operates as to drive surface of to drive segment.

8. The improved drive roll according to claim 7, wherein to drive roll is an injection molded drive roll, wherein to mounting disks with to support surfaces and the guide disks are parts of a unitary injection molded structure.

9. The improved drive roll according to claim 8, wherein to guide disks are of a radius which exceeds the radius of the mounting disks by about to thickness of the elastomer band.

10. The improved drive roll according to claim 7, wherein to injection molded drive roll is injected molded from a molding composition including a polymeric resin selected from the group consisting of ABS resins, polycarbonate resins, polyester resins, polyacetal resins ad nylon resins.

11. A dispenser for dispensing rolls of paper towel comprising:

(a) a housing;

(b) means for rotatably mounting rolls of paper towel in the housing;

(c) a feed nip including a drive roll and adapted to cooperate to advance the towel to a dispensing chute;

(d) a cutter bar disposed between to feed nip ad to dispensing chute; and (e) wherein the dispensing chute is provided with a textured delivery tray surface configured to guide to dispensed towel forward toward a dispensing aperture, the textured delivery tray surface having a topography free from projections other than the texture provided thereto.

12. The dispenser according to claim 11, wherein the textured delivery tray surface of the dispensing tray is an injection-molded tray surface produced in a textured mold.

13. The dispenser according to claim 12, wherein the textured mold has a surface finish at least as rough as an SPI D-2 surface finish.

14. The dispenser according to claim 12, wherein the textured mold has a surface finish at least as rough as an SPI D-3 surface finish.

15. The dispenser according to claim 12, wherein the textured mold has an SPI D-3 surface finish.

16. In a towel dispenser for dispensing rolls of paper towel of the class including a housing, means for rotating mounting the roll within the housing, drive means for advancing the towel to a dispensing chute and a cutter bar located between the drive means and a dispensing chute, the improvement comprising providing the delivery chute with a textured delivery tray surface configured to guide dispensed towel forward over the cutter bar to a dispensing aperture, wherein the textured delivery tray surface has a topography free from projections other than the texture provided thereto.

17. The improvement according to claim 16, wherein the surface of the delivery tray has a texture of less than about 100 microns.

18. A method of dispensing paper towel from a primary feed roll and a partially depleted stub roll comprising:

(a) providing a towel dispenser with housing, an elevated mounting rack for rotatably mounting a primary feed towel roll, a stub roll cavity below the elevated towel mounting rack and drive means for advancing paper towel from the rolls to a dispensing chute, the drive means consisting of: a feed nip with (i) a drive roll and (ii) a nip roll as well as (iii) means for rotating the drive and nip rolls;

(b) rotatably mounting a primary feed paper towel roll on the elevated mounting rack;

(c) concurrently with step (b) disposing a partially depleted stub roll in the stub roll cavity below the primary feed roll;

(d) concurrently with steps (b) and (c), providing towel from both the primary feed roll and the stub roll into the feed nip such that towel from both the primary feed roll and the stub roll are advanced when the drive and nip rolls are rotated in a dispensing direction; and (e) simultaneously dispensing towel from both the primary feed roll and the stub roll through the feed nip.

19. The method according to claim 18, wherein the drive roll has an elongate axis and a plurality of drive segments defining drive surfaces disposed along its length of generally equal radius with respect to the elongate axis of the roll, as well as a plurality of guide disks interposed between adjacent drive segments configured to alleviate wrinkling as the towel is dispensed.

20. The method according to claim 18, wherein the dispensing chute has a textured delivery tray surface with a topography otherwise free of projections.

* * * * *